US006988726B2

(12) United States Patent
Speller

(10) Patent No.: US 6,988,726 B2
(45) Date of Patent: Jan. 24, 2006

(54) METHOD AND APPARATUS FOR OVERLAPPING SHEETS IN A SHEET FEEDER AND PROVIDING THE OVERLAPPED SHEETS TO A PRINTING PRESS

(75) Inventor: Michael Speller, Aurora (CA)

(73) Assignee: Magnum Manufacturing Limited, Schomberg (CA)

( * ) Notice: Subject to any disclaimer, the term of this patent is extended or adjusted under 35 U.S.C. 154(b) by 78 days.

(21) Appl. No.: 10/392,957

(22) Filed: Mar. 21, 2003

(65) Prior Publication Data

US 2003/0218292 A1 Nov. 27, 2003

Related U.S. Application Data

(63) Continuation of application No. PCT/CA03/00398, filed on Mar. 20, 2003.
(60) Provisional application No. 60/366,251, filed on Mar. 22, 2002.

(51) Int. Cl.
*B65H 7/00* (2006.01)

(52) U.S. Cl. ..... 271/256

(58) Field of Classification Search ..... 271/69, 271/182, 202, 203, 270, 188; 101/415.1
See application file for complete search history.

(56) References Cited

U.S. PATENT DOCUMENTS

| | | | | |
|---|---|---|---|---|
| 1,220,623 A | * | 3/1917 | Gardner | 271/270 |
| 2,082,240 A | * | 6/1937 | Belluche et al. | 271/270 |
| 2,177,460 A | * | 10/1939 | Frederick | 271/199 |
| 2,261,973 A | * | 11/1941 | Landaff | 271/202 |

(Continued)

FOREIGN PATENT DOCUMENTS

| | | | | |
|---|---|---|---|---|
| DE | 101 03 040 A1 | | 11/2001 | |
| GB | 2166717 | * | 5/1986 | |
| JP | 63315457 | | 12/1988 | |
| JP | 63-315457 A | * | 12/1988 | |
| JP | 63-315457 | * | 12/1988 | 271/306 |
| WO | WO 93 15006 A | | 8/1993 | |

OTHER PUBLICATIONS

Heidelberg, CutStar—The Benefits of reel paper for sheet-fed offset, Printed Germany, Aug. 2001.

*Primary Examiner*—Donald P. Walsh
*Assistant Examiner*—Mark J. Beauchaine
(74) *Attorney, Agent, or Firm*—Bereskin & Parr

(57) ABSTRACT

The present invention is directed to a sheet feeding apparatus and method. In particular this invention comprises a sheet feeding apparatus having a first conveyance member, a second conveyance member, and a sheet bending member. The first conveyance member conveys a sheet from a source of sheets at the first speed. The second conveyance member is positioned near the first conveyance member, and conveys the sheets away from the first conveyance member at a second speed that is less than the first speed of the first conveyance member. The sheet bending member is positioned to engage the sheet as the sheet moves from the first conveyance member to the second conveyance member. The sheet bending member engages the sheet to produce a gap between the tail end of the sheet and the second conveyance member. The lead edge of the next adjacent sheet from the first conveyance member is then fed into the gap. The apparatus also comprises a conveyance member for conveying a stream of overlapping sheets to the printing press. The conveyance member can have at least two portions pivotally connected to one another with at least one of the portions pivotally connected to the source of the stream of overlapping sheets. The conveyance member is constructed so that the portions can retract from the printing press in respect of pivotal connections.

17 Claims, 15 Drawing Sheets

U.S. PATENT DOCUMENTS 2,367,416 A * 1/1945 Landaff ..... 271/303
3,026,107 A * 3/1962 Stroud ..... 270/58.01
3,198,046 A * 8/1965 De Angelo ..... 83/24
3,604,316 A * 9/1971 Labombarde ..... 493/438
3,861,515 A 1/1975 Runyan et al.
4,136,865 A 1/1979 Marass
4,200,016 A * 4/1980 Helmig et al. ..... 83/88
4,270,743 A 6/1981 Crampton
4,302,001 A 11/1981 Liepert
4,436,302 A * 3/1984 Frye et al. ..... 271/202
4,465,361 A * 8/1984 Rumsey ..... 399/268
4,813,660 A 3/1989 Dodd et al.
4,867,435 A 9/1989 Cogswell et al.
4,898,373 A 2/1990 Newsome
5,150,891 A 9/1992 Svyatsky et al.
5,275,394 A 1/1994 Mank et al.
5,280,896 A * 1/1994 Yamada ..... 271/3.08
5,417,416 A * 5/1995 Marmin et al. ..... 271/270
6,022,017 A 2/2000 Cummings et al.
6,142,462 A 11/2000 Moser et al.

* cited by examiner

METHOD AND APPARATUS FOR OVERLAPPING SHEETS IN A SHEET FEEDER AND PROVIDING THE OVERLAPPED SHEETS TO A PRINTING PRESS

FIELD OF THE INVENTION

This invention relates to a method and apparatus for overlapping sheets in a sheet feeder. This invention also relates to providing the stream of overlapped sheets to a printing press.

BACKGROUND OF THE INVENTION

There are known sheet feeding apparatus available to take a web from a roll of paper, cut the web into individual sheets, and then arrange the cut sheets in an overlapping or shingle fashion. Traditionally, the lead sheets of the shingled stream of such apparatus are on the bottom of the overlapped sheets. In other words, each cut sheet has its rear edge overlapped by the lead edge of the next adjacent sheet cut from the sheeter.

A printing press is designed to receive, however, a "reverse shingle" stream of sheets wherein the lead sheets of the shingled stream are on the top of the overlapped sheets. In other words, the rear edge of a cut sheet overlaps the lead edge of the next adjacent sheet cut from the sheeter. At least from a cost perspective, it is desirable to use a roll of paper as a source of cut sheets for a printing press.

In the past sheet feeding apparatus have accomplished "reverse shingling" by providing a vacuum stream feeder that acts to pick up the cut sheets one at a time from the sheets as they are being loaded into the printing press.

SUMMARY OF THE INVENTION

The present invention is directed to a sheet feeding apparatus and method suitable for use with a printing press. In particular, this invention comprises a sheet feeding apparatus having a first conveyance member, a second conveyance member, and a sheet bending member.

The first conveyance member conveys or transports a sheet from a source of sheets at a first speed. The second conveyance member is positioned near the first conveyance member, and conveys or transports the sheet away from the first conveyance member at a second speed that is less than the first speed of the first conveyance member.

The sheet bending member is positioned to engage the sheet as the sheet moves from the first conveyance member to the second conveyance member. The sheet bending member engages the sheet to produce a gap between the tail end of the sheet and the second conveyance member. The lead edge of the next adjacent sheet from the first conveyance member is then fed into the gap. Since the speed of the next adjacent sheet is the speed of the first conveyance, which is greater than the speed of the sheet having the gap that is now on the second conveyance, the lead edge of the next adjacent edge is fed into the gap.

The sheet bending member can comprise a sheet feeding roller and a forming roller. These rollers cooperate with one another to produce the gap. The sheet feeding roller can also assist in feeding the sheet to the second conveyance member. The sheet feeding roller and the forming roller are positioned to sequentially engage the sheet. For the embodiment disclosed the forming roller is positioned to engage the sheet after the sheet feeding roller. In the embodiment disclosed the sheet feeding roller and the forming roller cooperate to curl the sheet to produce the gap between the tail end of the sheet and the second conveyance member.

Moreover, the forming roller is positioned generally above the sheet feeding roller but with its lower edge below the upper edge of the sheet feeding roller. The sheet feeding roller can have a larger diameter than the diameter of the forming roller.

The invention also provides for a method of overlapping sheets in a stream of sheets in a sheet feeder. The method comprises transporting a sheet from a source of sheets, bending the sheet to produce a gap between the tail end of the sheet and the transporting means, and feeding the lead edge of the next adjacent sheet into the gap.

The bending of the sheets can be accomplished by sequentially feeding a sheet through at least two rollers as previously mentioned, and, for one embodiment of the invention, by sequentially feeding the sheet through the sheet feeding roller and the forming roller. These rollers cooperate to curl the sheet to produce the gap.

To feed the lead edge of the next adjacent sheet into the gap, the sheet is transported from the first conveyance member to the second conveyance member. As previously mentioned, the second conveyance member has a speed that is less than the speed of the first conveyance member. Accordingly, the speed of the sheet as it rides on the second conveyance member is less than the speed of the next adjacent sheet from the first conveyance member. Hence the lead edge of the faster next adjacent sheet is fed into the gap.

This invention also provides for a sheet feeding apparatus for transporting a stream of overlapping sheets to a printing press. The apparatus comprises a conveyance member for conveying the stream of overlapping sheets to the printing press. The conveyance member can have at least two portions pivotally connected to one another and with one of the portions pivotally connected to the source of the stream of overlapping sheets.

The apparatus also has a lifting member connected to the conveyance member to raise and lower the conveyance member about the pivotal connection to the source of the stream of overlapping sheets. The lifting member can be a hydraulic lift. In an embodiment of the invention the lifting member is connected to the portion of the conveyance member pivotally connected to the source of the stream of overlapping sheets.

In operation, when the conveyance member is in a lowered position a portion of the conveyance member away from the portion pivotally connected to the source of the stream of overlapping sheets can be swung upwardly about the pivotal connection between the portions.

BRIEF DESCRIPTION OF THE DRAWINGS

For a better understanding of the present invention and to show more clearly how it would be carried into effect, reference will now be made, by way of example, to the accompanying drawings that show a preferred embodiment of the present invention, and in which.

DETAILED DESCRIPTION OF THE INVENTION

Figure 1:
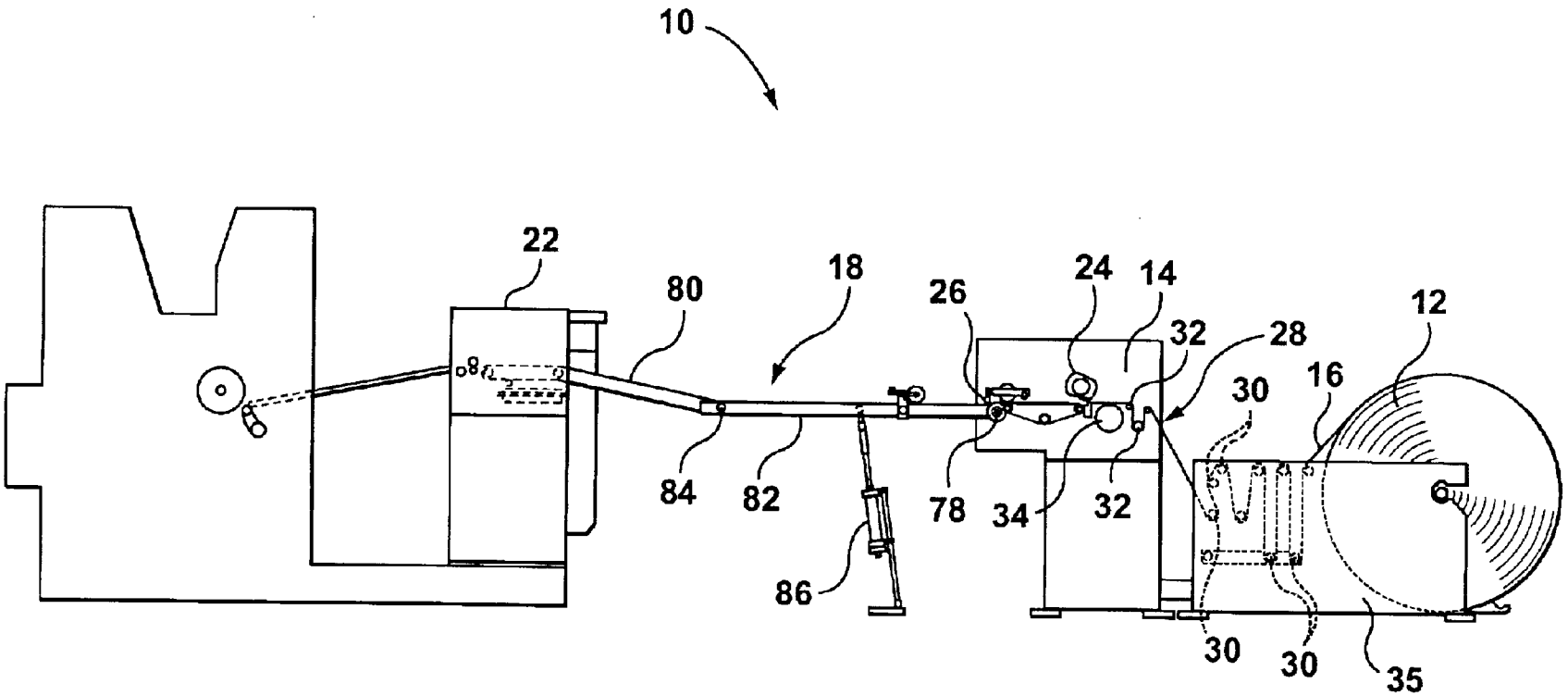
FIG. 1 is a schematic view of a sheet feeding apparatus feeding a reverse shingled stream into a printing press.

A sheet feeding apparatus 10 is generally disclosed in FIG. 1. The apparatus 10, as illustrated, comprises, generally, a roll of paper 12, a housing 14, to receive a web 16 from the roll of paper 12 and cut the web into individual sheets, and a conveyance, indicated generally at 18, to convey or transport the cut sheets as a shingled stream 20 for further processing. In the embodiment disclosed in FIG. 1, the shingled stream 20 is conveyed to a printing press 22. The housing 14 can retain a sheet cutter or sheeter 24 to cut the web 16 into sheets for the shingled stream 20, and a sheet bending member, indicated generally at 26 to overlap the cut sheets, as will hereinafter be described.

Referring to FIG. 1 the roll of paper 12 provides a web 16 that is fed into housing 14 as at 28. The web 16 is transported through a series of rollers 30 to housing 14. Within housing 14 the web 16 is transported through another series of rollers 32 to a first sheet feeding roller 34 that directs the web 16 to the sheeter 24. The roll of paper 12 and the rollers 30 can be housed in a separate housing 35. Rollers 30 and 32, and first sheet feeding roller 34 are operated to transport the web 16 from the roll of paper 12 to the sheeter 24 at a controlled speed.

Figure 3:
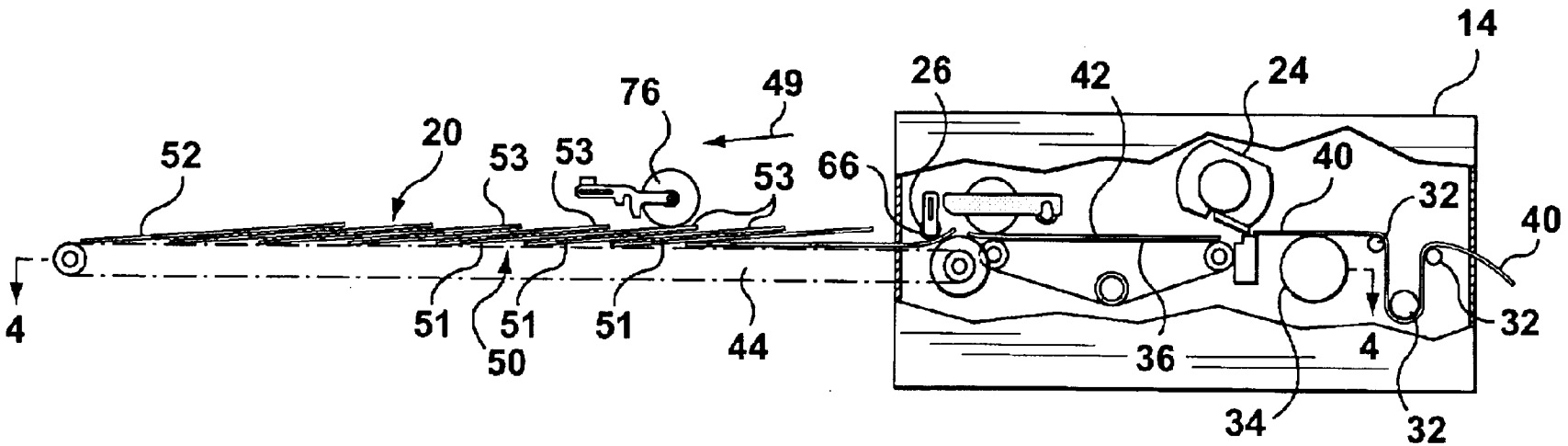
FIG. 3 is a schematic view of the sheet feeding apparatus of this invention for producing a reverse shingle stream of overlapping sheets.

As best illustrated in FIG. 3, rollers 32 and first sheet feeding roller 34 within housing 14 feed the web 16 to a first conveyance member 36 of the conveyance 18 of the sheet feeding apparatus 10. The first conveyance member 36 comprises a table of fast moving belts 38 (see FIG. 4) that receive the controlled infeed of the web 16. The surface speed of the belts 38 is slightly greater than the speed of the controlled infeed of the web 16 and this produces an overfeeding effect as the portion of the web 40 on belts 38 takes up the speed of the belts 38 of the first conveyance member 36. Once a desired length of the web 40 has been fed onto the fast belts 38 the web is cut off by the sheeter 24. The cut sheet 42 is now free from the web and is able to pick up the entire speed of the fast moving belts 38. The sheeter 24 thereby provides a source of cut sheets 42 to the conveyance 18.

The conveyance 18 of the sheet feeding apparatus 10 also comprises a second conveyance member 44 that comprises a table of slow moving belts 46 (see FIG. 4), at least compared to the speed of the belts 38 of the first conveyance member 36.

Figure 2:
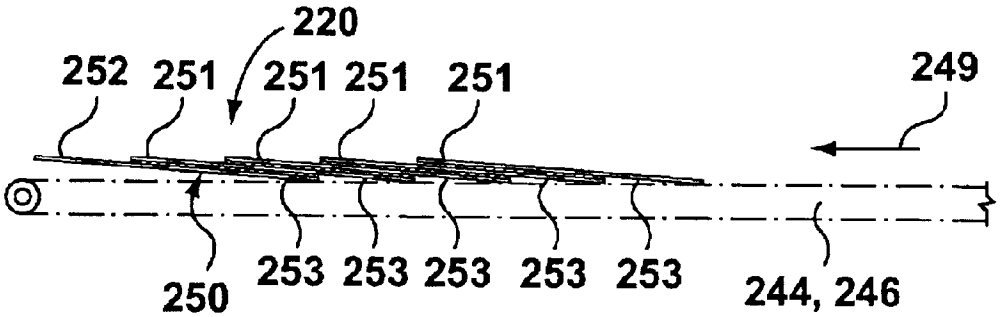
FIG. 2 (Prior Art)
FIG. 2 illustrates an overlapping or shingled stream from a prior art sheet feeding apparatus.

As illustrated in FIG. 2 (prior art), in a known sheet feeding apparatus, cut sheets 242 are transported from fast moving belts of a first conveyance member to slow moving belts 246 of a second conveyance member 244, traveling in the direction of arrow 249. As a sheet moves onto the table of slow moving belts 246 it takes the speed of the slow moving belts 246 and slows down. The next adjacent sheet that was just cut from the sheeter is still traveling over the fast moving belts. As the next adjacent sheet is transported to the slow moving belts 246, its speed is temporarily greater than the speed of the sheet that has previously moved onto the slow moving belts 246. This forms a stream of overlapped sheets 252, by allowing the next adjacent sheets from the sheeter to overlap the sheets on the slow moving belts 246 so that the leading edge 251 of each next adjacent sheet rests on top of the trailing edge 253 of each previously fed sheet, as at 250. In other words, each overlapping sheet 252 has its trailing edge 253 overlapped by the lead edge 251 of the next adjacent sheet cut from the sheeter.

Printing presses, for example 22, in FIG. 1, are designed to receive, however, a stream 20 of overlapped sheets 52 wherein the leading edge 51 of each next adjacent sheet is shingled underneath the trailing edge 53 of a previously fed sheet, as illustrated, for example, at 50 in FIG. 3. To achieve a "reverse shingle" overlap in a stream 20 of sheets 52 the sheet bending member 26 is provided, as illustrated in FIG. 3, and FIGS. 5–10, inclusive.

The sheet bending member 26 is positioned to engage a cut sheet 42 as the sheet moves from the first conveyance member 36 to the second conveyance member 44. In particular, as illustrated in FIG. 3 and in more detail in FIGS. 5–10, the bending member 26 engages a particular cut sheet 54 to produce a gap 56 between the tail end 58 of the sheet 54 and the second conveyance member 44. The gap 56 is sufficient in extent to receive therein the lead edge 60 of the next adjacent sheet 62, as will be described in more detail.

Figure 4:
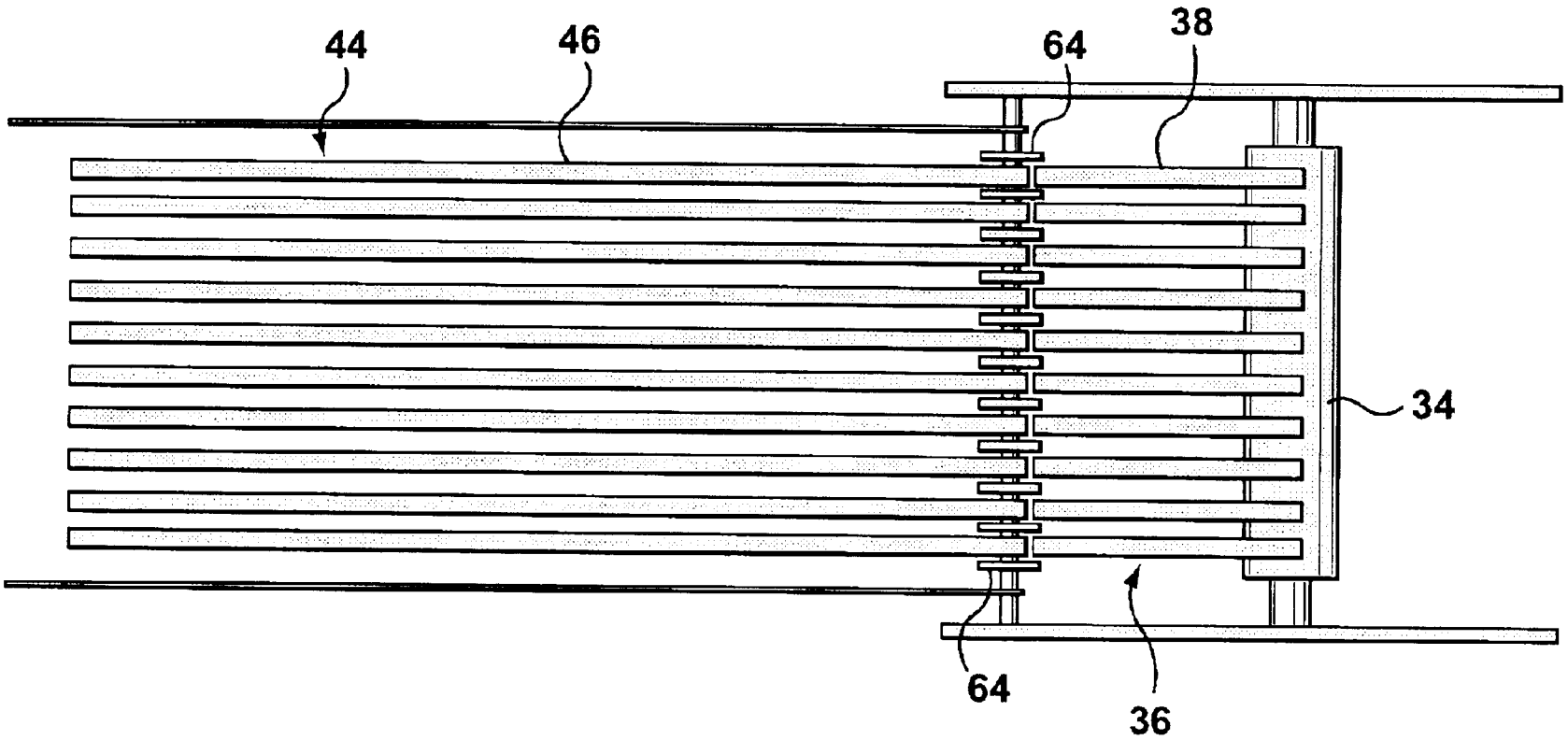
FIG. 4 is a cross sectional view taken along the lines 4—4 of FIG. 3.

With particular reference to FIGS. 5–10, the sheet bending member 26 can comprise a second sheet feeding roller 64 and a forming roller 66. The second sheet feeding roller 64 can rotate about the same drive axis 68 for the slow moving belts, as illustrated in FIG. 4. The second sheet feeding roller 64 and the forming roller 66 are positioned to sequentially engage the sheet 54 as the sheet moves from the fast belts 38 of the first conveyance member 36 to the slow belts 46 of the second conveyance member 44. For the embodiment disclosed, the forming roller 66 is positioned to engage the sheet 54 after the sheet feeding roller 64. Also, as illustrated, the forming roller 66 is positioned generally above the second sheet feeding roller 64, but with its lower edge 70 below the level of the upper edge 72 of the second sheet feeding roller 64. This produces, as will hereinafter be described, a bend in the sheet of paper 54 to produce the gap 56. Also, as illustrated, the diameter of the second sheet feeding roller 64 is larger than the diameter of the forming roller 66. A limiting block 67 may be provided above the second sheet feeding roller 64, and adjacent to the forming roller 66 to limit the amount of bend produced in sheet 54.

Figure 5:
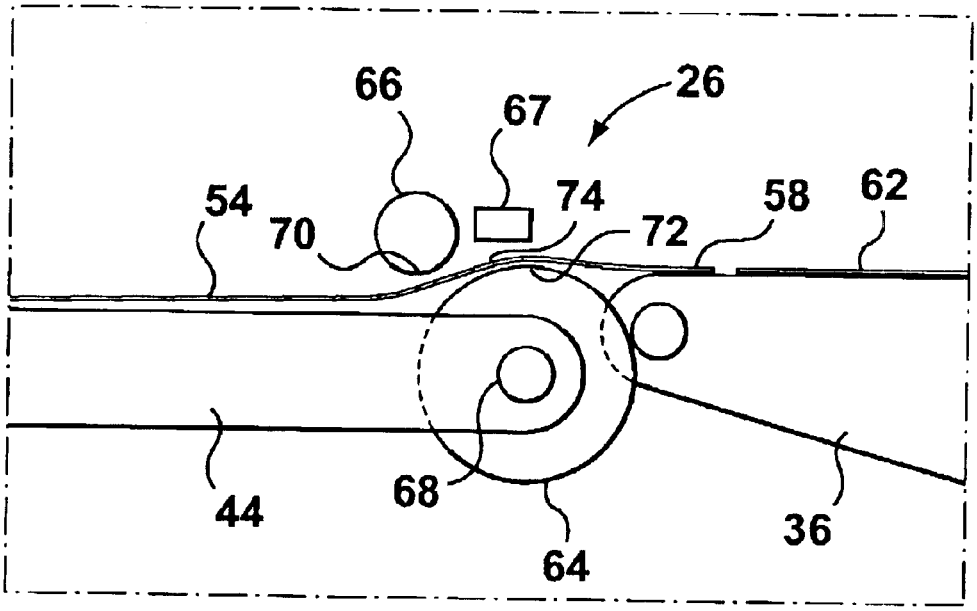
FIGS. 5–10, inclusive, schematically illustrate the overlapping of the sheets in a "reverse shingle" manner as provided by this invention.
Figure 6:
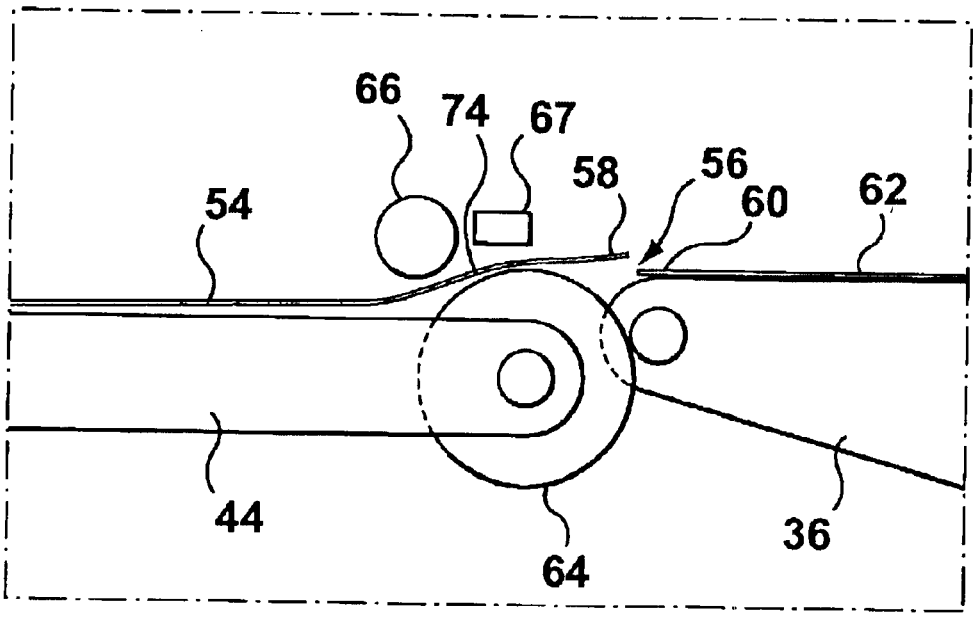
Figure 7:
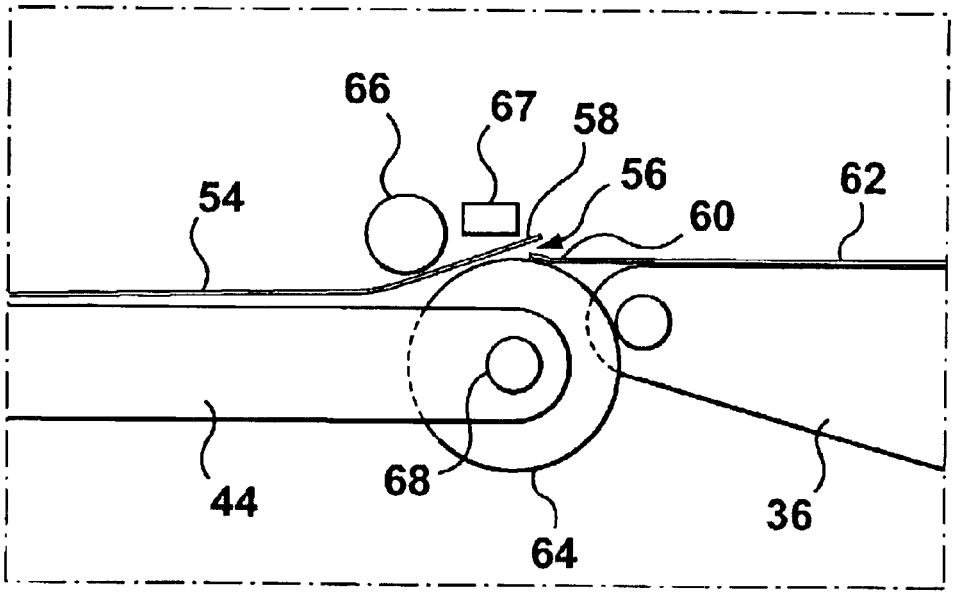
Figure 8:
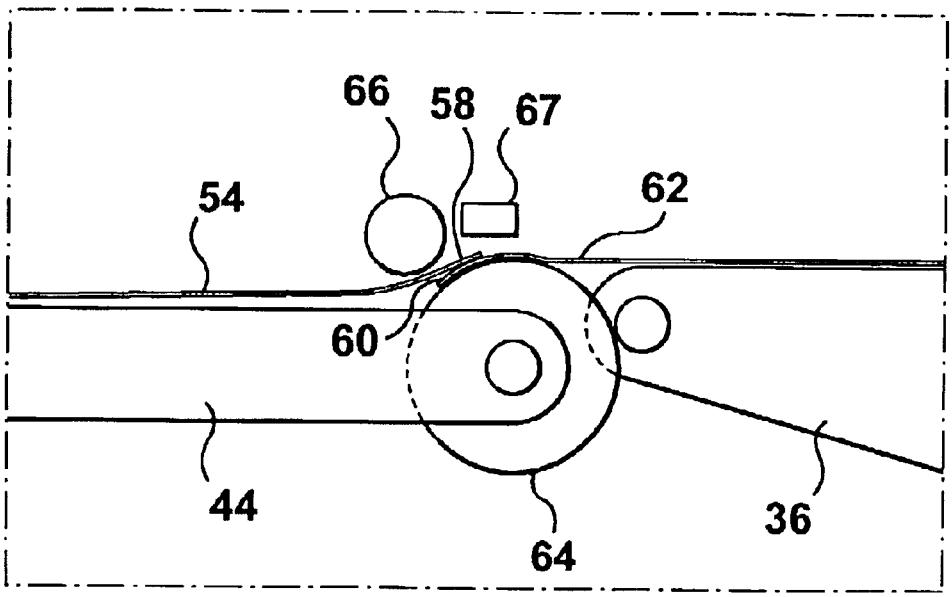
Figure 9:
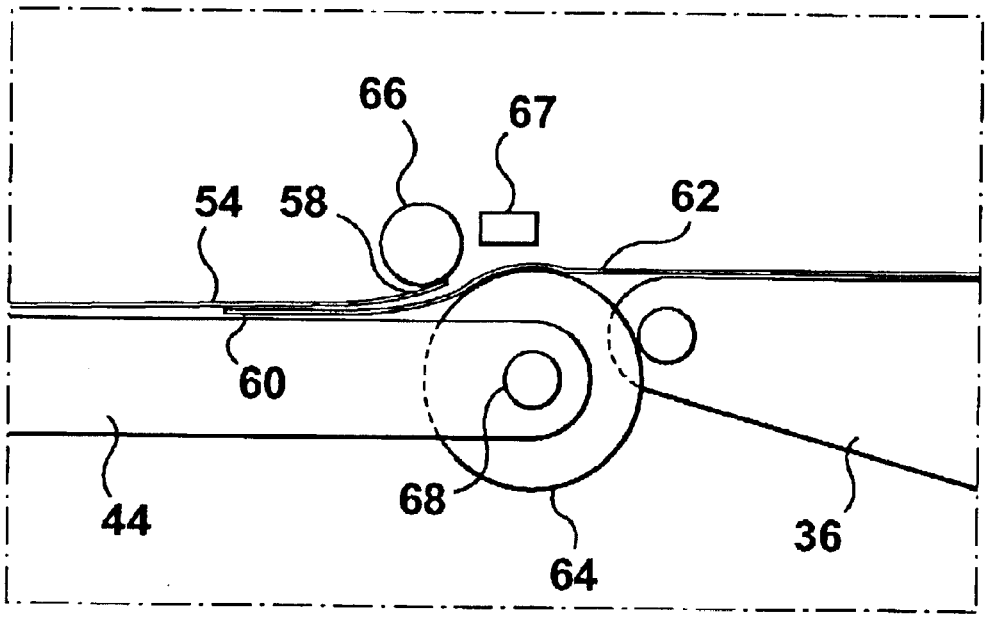

The operation of the sheet feeding apparatus 10 and the method for overlapping sheets will now be described in detail making reference to FIGS. 5–10. In particular, as illustrated in FIG. 5, a sheet 54 from the fast moving belts 38 of the first conveyance member 36 has been substantially transported or conveyed to the slow moving belts 46 of the second conveyance member 44 so that a trailing portion 74 of the sheet 54 is still passing through the second sheet feeding roller 64 and the forming roller 66 of the bending member 26. As more of the sheet 54 is fed onto the slow moving belts 46 of the second conveyance member 44 the speed of the sheet 54 slows to match the speed of the slow moving belts 46. The speed of the sheet can match that of belts 46 once all of the sheet 54 is on the belts 46 of the second conveyance member 44. In FIG. 5, however, the speed of the sheet 54 is slowing so that its speed is slower than the next adjacent sheet 62 on the fast moving belts 38 of the first conveyance member 36. As the sheet 54 passes through the forming roller 66 and second sheet feeding roller 64, and because of the positioning of these rollers with respect to one another, the rear edge or tail end 58 of the sheet 54 bends away from the second conveyance member 44, as illustrated in FIG. 6. In particular, the second sheet feeding roller 64 and the forming roller 66 cooperate to curl the sheet as it passes therethrough, which produces the gap 56 at the rear edge or tail end 58. The amount that sheet 54 can be curled is limited by the limiting block 67. The tail end 58 of the sheet 54 can only curl away from roller 64 of the second conveyance member 44 to the extent that space is provided between the roller 64 and the limiting block 67.

Figure 10:
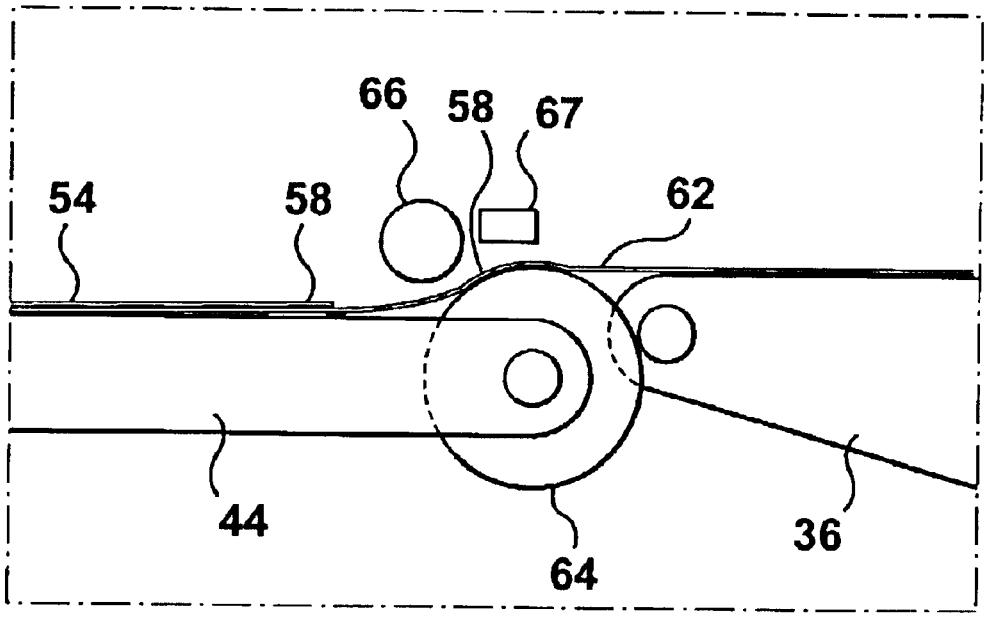

The next adjacent sheet 62 from the first conveyance member 36 is traveling at the speed of the fast belts 38 of such member. This faster speed drives the next adjacent sheet 62 into the gap 56 produced by the bending of the tail end 58 of the sheet 54 so that the sheet 54 overlaps the next adjacent sheet 62. As the sheet 64 is fed progressively onto the slow moving belts 46 of the second conveyance member 44, the sheet 62 is fed further into the gap 56 due to its still higher speed (see FIG. 9). As illustrated in FIG. 10, a portion of the next adjacent sheet 62 is still engaging the fast moving belts 38 of the first conveyance member 36, and so that sheet will be fed progressively further into the gap 56 until it too has been fed fully onto the slow moving belts 46 of the second conveyance member 44 and taken up the same speed as the sheet 54.

This progress is repeated for each of the sheets, namely, transporting cut sheets from the source of sheets, namely, the sheeter 24, bending a particular sheet 54 to produce a gap 56 between the tail end 58 of the sheet 54 and the transporting means, namely the conveyance 18, and feeding the lead edge 60 of the next adjacent sheet 62 into the gap 56 produced. In this manner a stream 20 of "reverse shingle" overlapped sheets 52 is produced, traveling in the direction of arrow 49. As illustrated in FIG. 3 a stop wheel 76 can be provided to stabilize the stream 20 of reverse shingled sheets 52 and dampen any residual speed the sheets might have from the fast moving belts 38 of the first conveyance member 36.

As illustrated in FIG. 1 the sheet feeding apparatus 10 feeds a reverse shingled stream 20 of sheets 52 to the printing press 22. It might be desirable in some situations, however, to pass the sheets through the printing press 22 a number of times. For example, additional colors might be required and therefore a number of runs through the printing press 22 would be desired.

The first run would occur as the sheets are fed into the printing press 22 from the sheet feeding apparatus 10, as previously described. To make a second pass through the printing press 22, the second pass (or any subsequent passes) must be made from the sheets that have already been cut and loaded into the printing press 22 on the first pass. It is desirable in this situation to retract the second conveyance member 44 from the loading area of the printing press 22.

Figure 11:
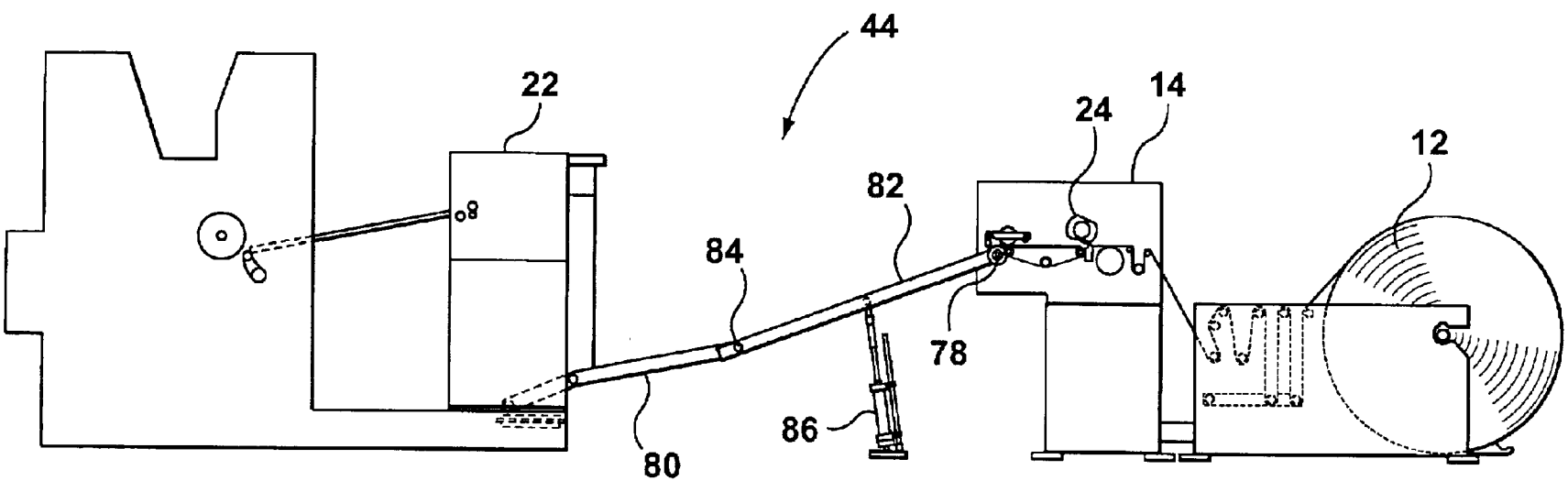
FIG. 11 is a schematic view of a conveyor portion of the sheet feeding apparatus in a lowered position relative to the printing press.
Figure 12:
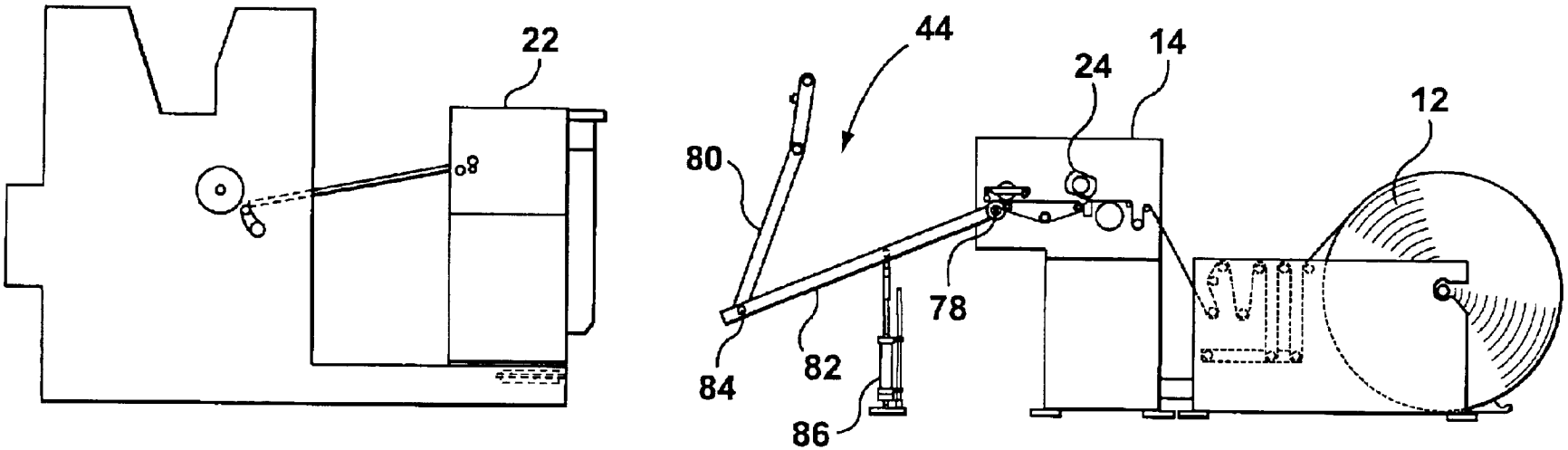
FIG. 12 is a schematic view of the conveyor portion of the sheet feeding apparatus in the lowered and retracted position relative to the printing press.

As illustrated in FIGS. 1, 11, and 12, the second conveyance member 44 that conveys the reverse shingled stream 20 of sheets 52 from the sheet bending member 26 to the printing press 22 can be pivotally connected, as at 78, to the upstream supply of the overlapping sheets (namely, housing 14). Moreover, the second conveyance member 44 can be comprised of a number of portions pivotally connected to one another, and in the embodiment illustrated comprises at least two portions 80, 82 that are pivotally connected together as at 84.

A lifting member 86, such as, for example, a hydraulic lift, can be connected to the second conveyance member 44 to raise and lower the second conveyance member 44 about the pivotal connection 78 to the upstream supply of the stream 20 of overlapping sheets 52. In the embodiments disclosed the lifting member 86 is connected to the portion 82 of the conveyance member that is pivotally connected to the upstream supply of the overlapping sheets.

Accordingly, in operation when at least a second pass through the printing press 22 is desired, the conveyance member 44 is lowered (as illustrated in FIG. 11). The portion 80 of the conveyance member 44 that is away from the portion 82 of the conveyance member 44 that is pivotally connected to the upstream supply of the overlapping sheets can be swung upwardly above the pivotal connection 84 (as illustrated in FIG. 12). This retracts the second conveyance member 44 of the sheet feeding apparatus 10 away from the printing press 22.

Figure 13:
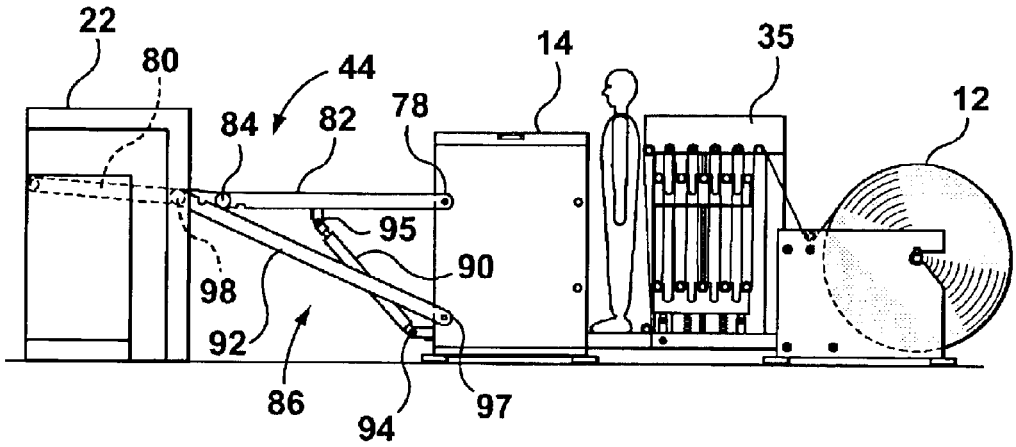
FIG. 13 is a schematic view of an alternative conveyor portion of the sheet feeding apparatus, shown in an engaged position with the printing press.

Referring now to FIG. 13, in an alternative embodiment for retracting the second conveyance member 44, lifting member 86 comprises an hydraulic cylinder 90 and a support strut 92. Cylinder 90 extends between pivot mounts 94 and 95, which are fixed to the housing 14 and to the second portion 82 of second conveyance member 44, respectively. Strut 92 extends between pivot mounts 97 and 98, which are fixed to the housing 14 and to the first portion 80 of the second conveyance member 44, respectively.

Figure 14:
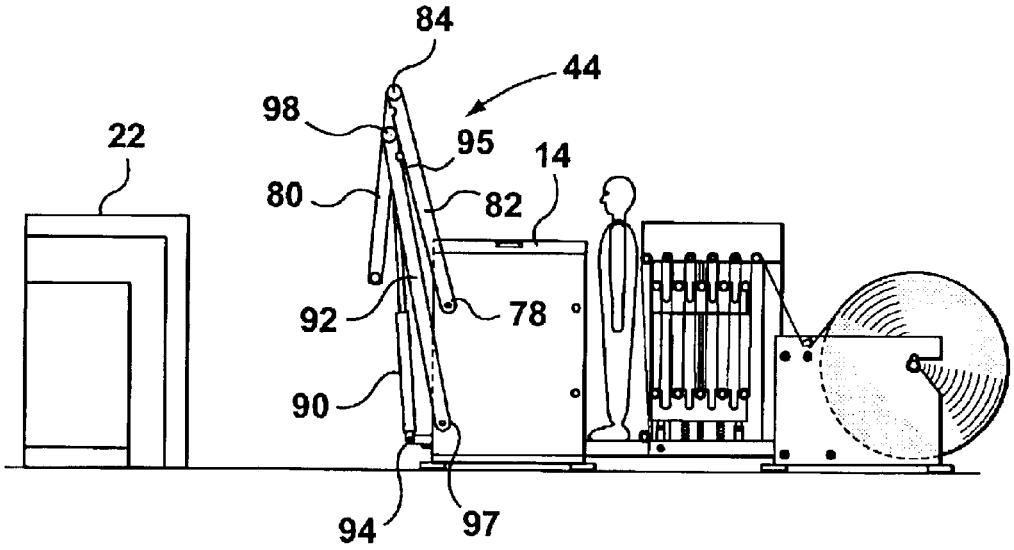
FIG. 14 is a schematic view of the apparatus of FIG. 13, showing the conveyor portion in a raised and retracted position relative to the printing press.

Referring now to FIG. 14, the second conveyance member 44 may be retracted away from the press 22 by extending the hydraulic cylinder 90. Such extension causes the second portion 82 of the second conveyance member 44 to swing upward, about the pivot 78. As this motion occurs, strut 92 serves to swing the first portion 80 of the second conveyance member 44 downwards, about the pivot 84. At full extension of the cylinder 90, the second conveyance member 44 is neatly folded up and held securely in place against the housing 14 (see FIG. 14).

Figure 15:
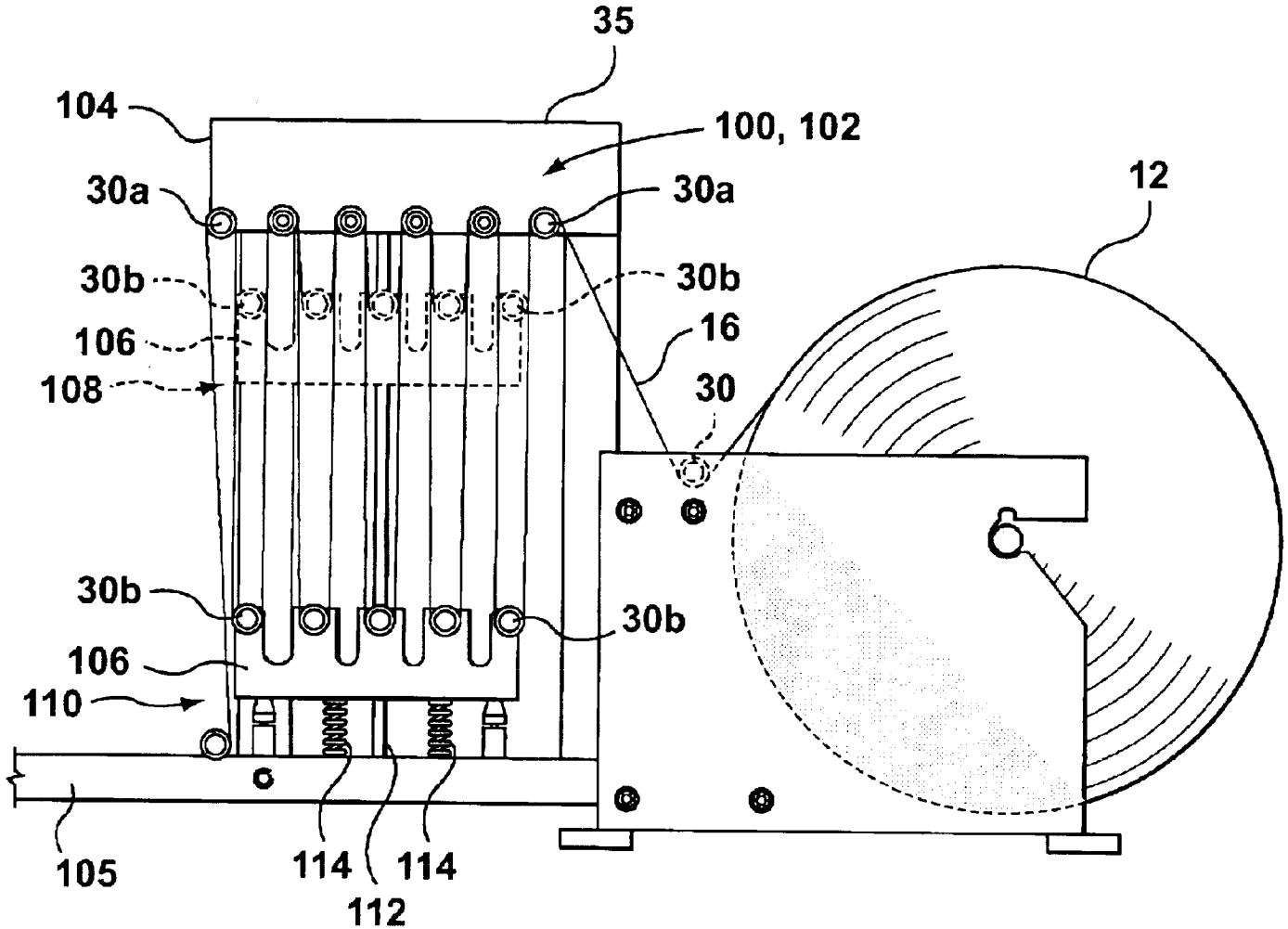
FIG. 15 is a schematic view of a festoon provided in accordance with the present invention.

Referring now to FIG. 15, the housing 35 may be provided to house the roll of paper 12 and the rollers 30, as described previously. Rollers 30 take up the web 16 from the roll of paper 12, and direct the web 16 to the sheeter 24. It may be advantageous to provide an isolating buffer zone 100 for the web 16 between the roll 12 and the sheet 24. The buffer zone 100 may stabilize the speed and tension of the supply of the web 16 to the sheet 24, and may compensate for the inertia of the roll 12, particularly when starting and stopping the roll 12.

In one embodiment, a buffer zone 100 is provided in housing 35 in the form of a festoon 102. The festoon 102 has a series of upper rollers 30*a* fixed to a stationary support 104, and a series of lower rollers 30*b* attached to a carriage 106. The web 16 is fed alternately through the upper rollers 30*a* and the lower rollers 30*b*. The carriage 106 is movable between raised and lowered positions 108 and 110, respectively. The carriage 106 slides along vertical rails 112 extending between the stationary support 104 and the base 105. Biasing means 114, such as tension springs, may be provided to bias the carriage 106 towards the lowered position 110.

In operation, the web 16 extending between successive upper and lower rollers 30*a*, 30*b* of the festoon 102 provides a buffered supply of web 16 to the sheeter 24. Furthermore, the biasing means 114 of the festoon 102 can maintain a desired amount of tension on the web 16, even if, for example, the roll 12 ran empty.

It is appreciated that to install the various components of apparatus 10 in front of a press 22 may require a considerable length of floor space. This may be particularly true when the equipment is arranged so that the web 16 travels from the roll 12 to the press 22 along a straight line.

In some cases, it may desirable to install the equipment in a configuration other than along a straight line. Such a configuration may require that the direction of travel of the web 16 be altered, for example, by 90°.

Figure 16:
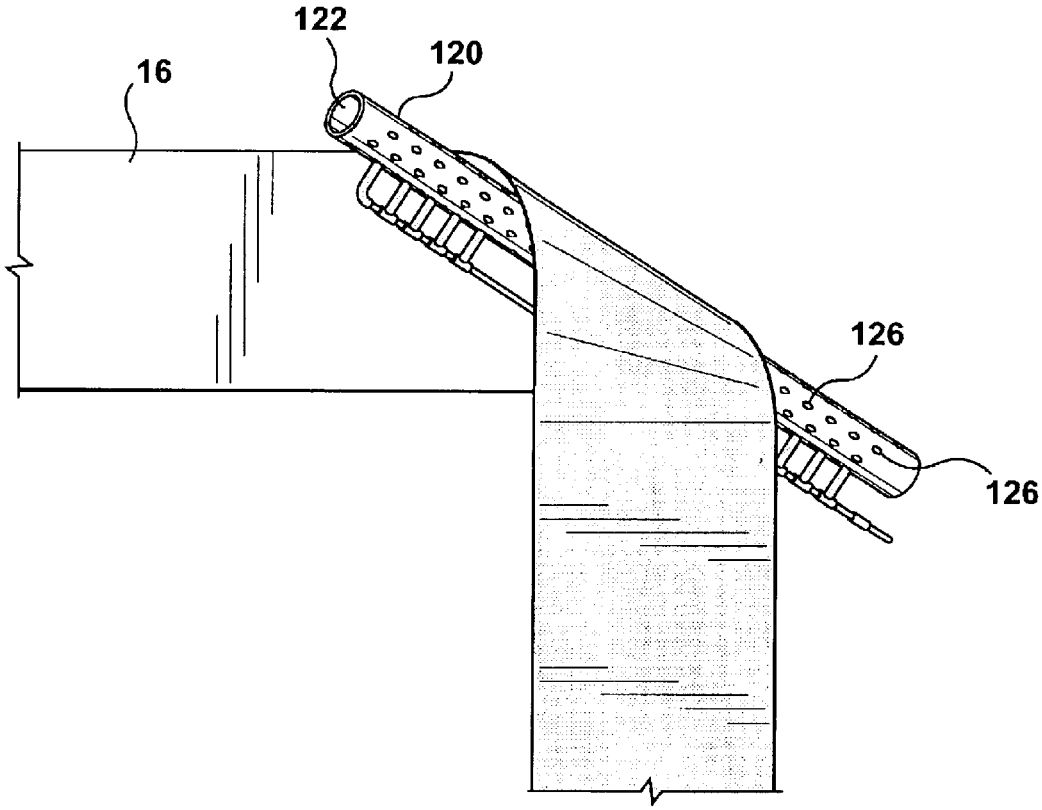
FIG. 16 is an isometric view of a device for redirecting paper web traveling between components of the sheet feeder apparatus.
Figure 17:
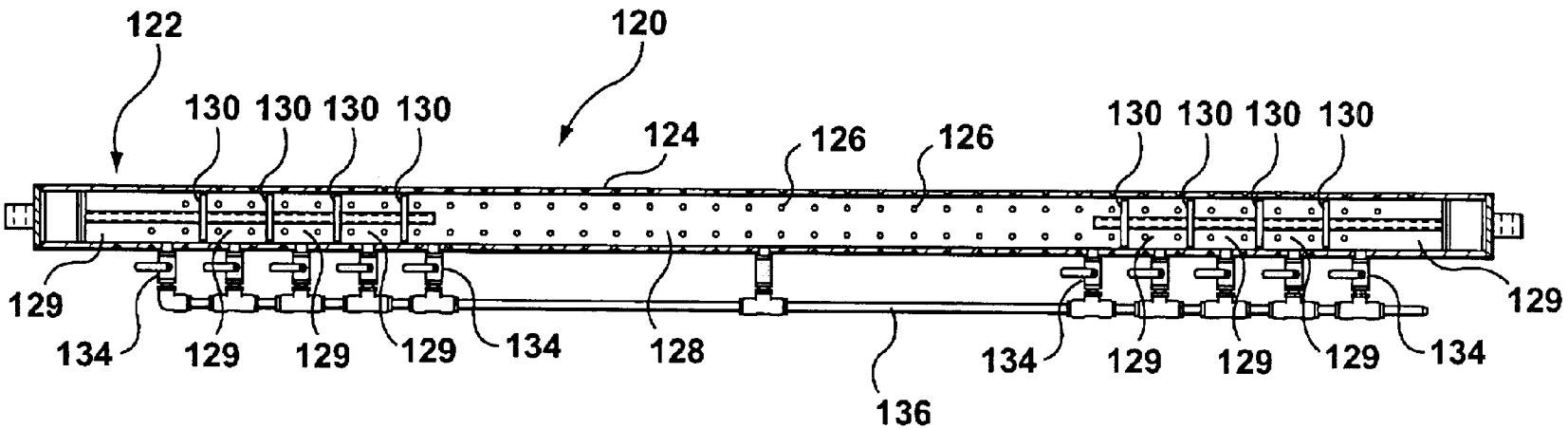
FIG. 17 is a schematic view of the device of FIG. 16.

Referring now to FIGS. 16 and 17, the apparatus 10 may be further provided with a turn bar 120 for changing the direction of travel of the web 16. In one embodiment, the turn bar 120 has a hollow tube 122 with an outer surface 124 which is provided with perforations 126. The tube 122 is capped at both ends, and the interior length of the tube 122 is divided into a central chamber 128 and a series of outer chambers 129, by seals 130.

Air is supplied to the central chamber 128 through ducts 132 connected to a header 136, which in turn is connected to a pressure regulated air supply. The ducts 132 may be provided with valves 134, which may be opened or closed to provide air (or not) to any one or more of the outer chambers 129.

In operation, the turn bar 120 may be oriented at 45° to the incoming direction of the web 16, in a plane which is substantially coplanar with the web 16. The web 16 may travel around the outer surface 124 of the turn bar 120, so that the direction of the web 16 leaving the turn bar 120 is at 90° to that of the incoming direction. The egress of air through the perforations 126 provides a cushion of air between the web 16 and the outer surface 124 of the turn bar 120, so that the web 16 may glide smoothly over the turn bar 120. The valves 134 may be opened or closed according to the width or the position of the web 16, relative to the outer surface 124 of the turn bar 120.

Referring now to FIGS. 18 to 23, various equipment lay-out configurations using turn bar 120 are possible.

Figure 18:
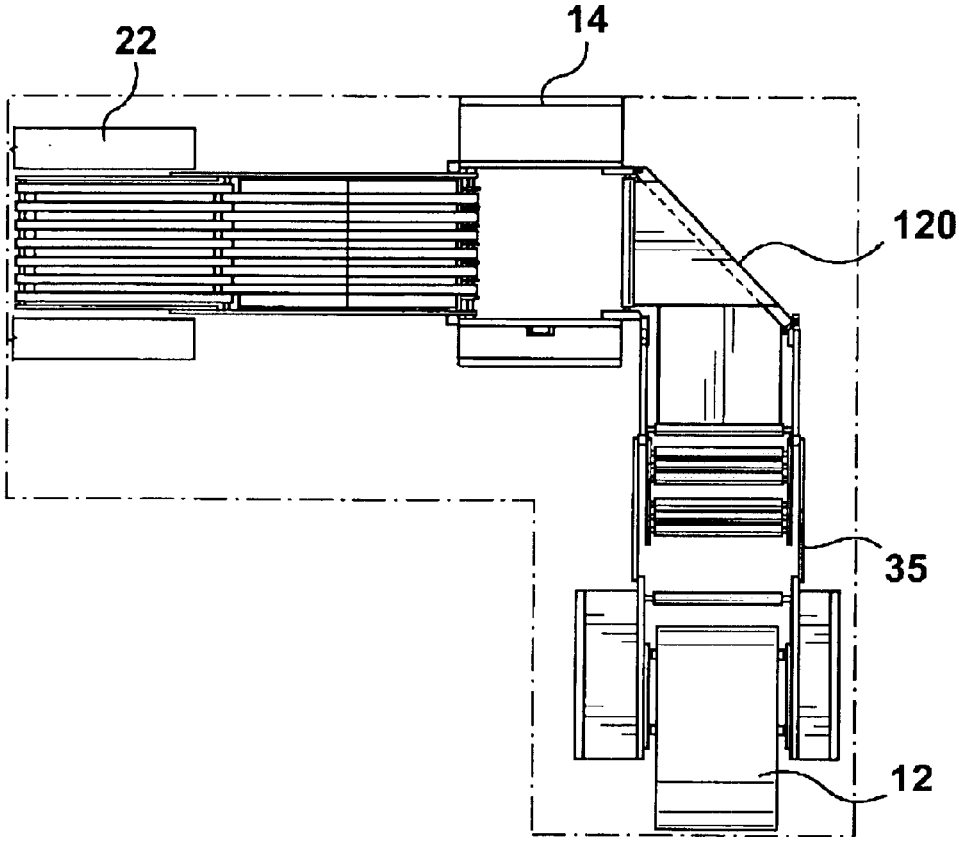
FIGS. 18, 20, and 22 are top plan views of optional equipment lay-out configuration for the sheet feeder apparatus.
Figure 19:
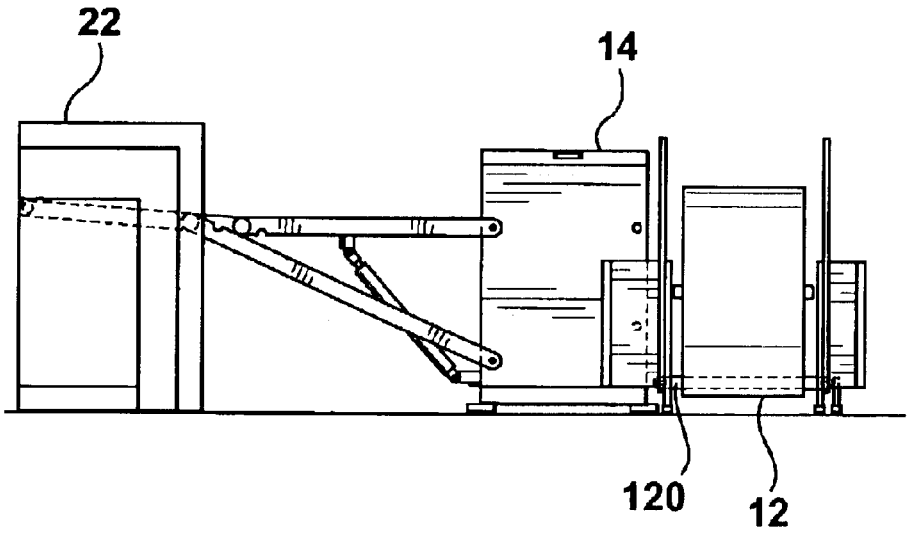
FIGS. 19, 21, and 23 are front elevation views corresponding to FIGS. 18, 20, and 22, respectively.

In FIGS. 18 and 19, the top view and front view, respectively, are shown for a 90° lay-out in which the turn bar 120 is provided in a horizontal plane between the housing 14 and the housing 35.

Figure 20:
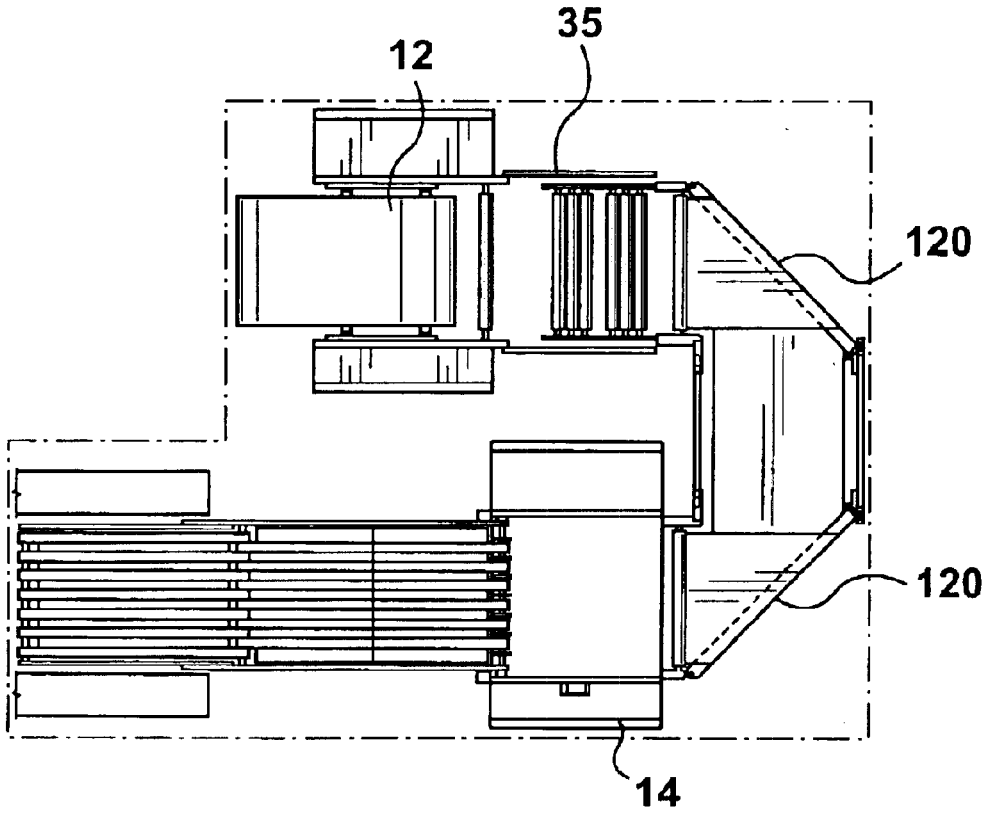
Figure 21:
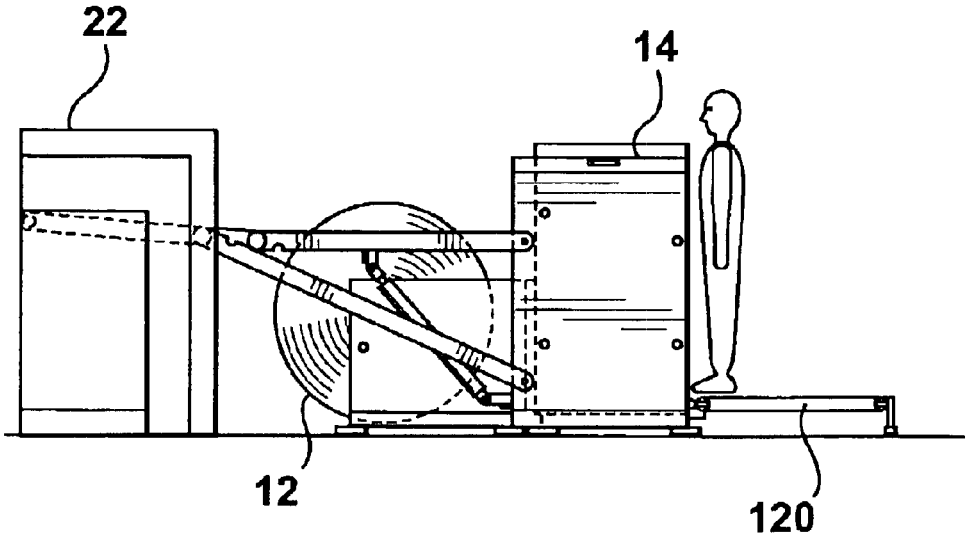

In FIGS. 20 and 21, the top view and front view, respectively, are shown for a 180° lay-out in which two turn bars 120 are provided in a horizontal plane between housings 14 and 35.

Figure 22:
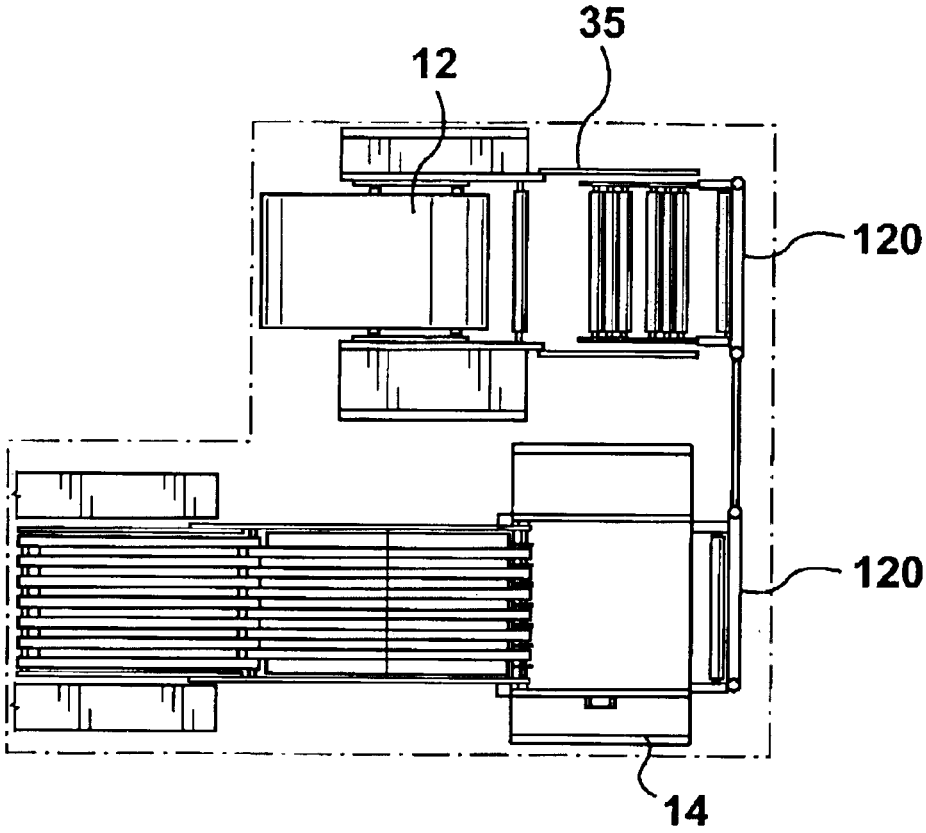
Figure 23:
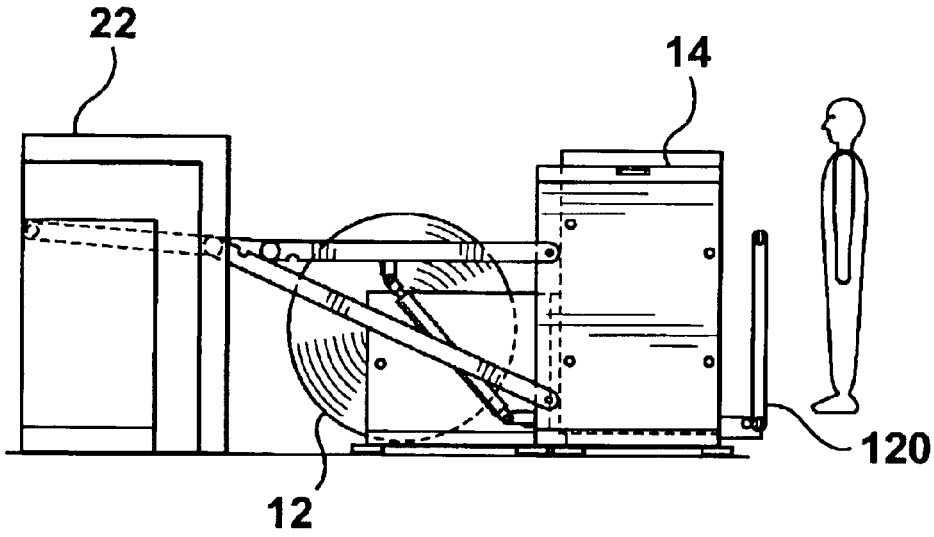

In FIGS. 22 and 23, the top view and front view, respectively, are shown for a 180° lay-out in which two turn bars 120 are provided in a vertical plane between housings 14 and 35.

It can be appreciated that variations to this invention would be readily apparent to those skilled in the art, and this invention is intended to include those alternatives.

What is claimed is:

1. A sheet feeding apparatus comprising:

(a) a first conveyance member for conveying a first sheet and a next adjacent sheet from a source of sheets, the first conveyance member having a first speed, the first and next adjacent sheets each having a lead edge and a tall end opposite the lead edge;

(b) a second conveyance member positioned near the first conveyance member for conveying the first sheet away from the first conveyance member, the second conveyance member having a second speed less than the first speed; and (c) a sheet bending member positioned to engage the first sheet as the first sheet moves from the first conveyance member to the second conveyance member, the sheet bending member including a sheet feeding roller to feed the first sheet to the second conveyance member and a forming roller positioned to engage the tail end of the first sheet in cooperation with the sheet feeding roller to produce a gap between the tall end of the first sheet and the second conveyance member into which the lead edge of the next adjacent sheet from the first conveyance member can be fed.

2. The sheet feeding apparatus according to claim 1 wherein the sheet feeding roller and the forming roller are positioned to sequentially engage the first sheet.

3. The sheet feeding apparatus according to claim 2 wherein the forming roller is positioned to engage the first sheet after the sheet feeding roller.

4. The sheet feeding apparatus according to claim 3 wherein the forming roller is positioned generally above the sheet feeding roller but with its lower edge below the upper edge of the sheet feeding roller.

5. The sheet feeding apparatus according to claim 4 wherein the sheet feeding roller has a larger diameter than that of the forming roller.

6. The sheet feeding apparatus according to claim 4, wherein the sheet bending member further comprises a limiting block provided above the sheet feeding roller and adjacent the forming roller.

7. The sheet feeding apparatus according to any one of claims 1 to 6, wherein the sheet bending member produces the gap between the tail end of the sheet and the second conveyance member by curling the first sheet.

8. The sheet feeding apparatus according to claim 1 wherein the source of sheets is a sheeter into which a web from a roll is fed.

9. The sheet feeding apparatus of claim 8 wherein the first speed of the first conveyance is greater than a third speed the web is fed into the sheeter.

10. The sheet feeding apparatus of claim 8 further comprising at least one turn bar disposed between the sheeter and the roll and around which the web travels, the web being fed to the turn bar from the roll in an incoming web direction, wherein the turn bar is positioned substantially coplanar with the web and oriented at an oblique angle relative to the incoming web direction.

11. A method of overlapping a stream of sheets in a sheet feeder, comprising:

(a) transporting a first sheet and a next adjacent sheet along a conveyance from a source of sheets, the first and next adjacent sheets each having a lead edge and a tall end opposite the lead edge;

(b) sequentially feeding the first sheet through first and second rollers of a sheet bending member, the first and second rollers positioned to cooperatively engage a trailing portion of the first sheet to produce a gap between the tail end of the first sheet and the conveyance; and (c) feeding the lead edge of the next adjacent sheet into the gap.

12. The method according to claim 11 wherein one of the first and second rollers in step (b) is a sheet feeding roller for feeding the first sheet along the conveyance.

13. The method according to claim 12 wherein step (b) comprises sequentially feeding the first sheet through a sheet feeding roller and a forming roller.

14. The method according to claim 13 wherein the sheet feeding roller and the forming roller cooperate to curl the first sheet to produce the gap.

15. The method according to any one of claims 11 to 14 wherein step (c) comprises slowing the speed of the first sheet so that the lead edge of the next adjacent sheet can be fed into the gap.

16. The method according to claim 15 wherein step (c) comprises transporting the first sheet from a first conveyance member to a second conveyance member, and wherein the first conveyance member has a speed that is greater than the speed of the second conveyance member.

17. The method according to claim 16 wherein the bending of the first sheet occurs as the first sheet is transported from the first conveyance member to the second conveyance member.

* * * * *